United States Patent [19]

Demetrius et al.

[11] Patent Number: 4,789,299

[45] Date of Patent: Dec. 6, 1988

[54] LIQUID AND AIR PUMP B

[76] Inventors: Kris Demetrius; George Spector, both of 233 Broadway Rm 3815, New York, N.Y. 10007

[21] Appl. No.: 114,515

[22] Filed: Oct. 30, 1987

[51] Int. Cl.[4] ..... F04D 3/02

[52] U.S. Cl. ..... 415/73; 415/111; 416/177

[58] Field of Search ..... 415/71–75, 415/111, 112, 151, 219 R; 416/176, 177

[56] References Cited

U.S. PATENT DOCUMENTS

| | | | |
|---|---|---|---|
| 605,888 | 6/1898 | Maginot | 415/72 X |
| 1,717,694 | 6/1929 | Kraut | 415/74 |
| 2,159,278 | 5/1939 | Lesley | 415/74 |
| 2,538,465 | 1/1951 | Marco | 416/177 X |
| 3,156,190 | 11/1964 | Stahle | 415/72 |
| 3,697,190 | 10/1972 | Haentjens | 415/73 |
| 4,568,253 | 2/1986 | Wood | 415/74 X |

FOREIGN PATENT DOCUMENTS

| | | | |
|---|---|---|---|
| 114479 | 4/1918 | United Kingdom | 415/72 |

*Primary Examiner*—Robert E. Garrett
*Assistant Examiner*—Joseph M. Pitko

[57] ABSTRACT

A compressor pump for conveying fluids is provided and consists of an electric motor driving a cone-shaped impeller within a stationary casing affixed to a stationary stand in which fluids entering the casing and through the impeller are compressed to exit therefrom into a hose affixed to the stand for carrying the compressed fluids.

3 Claims, 1 Drawing Sheet

LIQUID AND AIR PUMP B

BACKGROUND OF THE INVENTION

The instant invention relates generally to pumps and more specifically it relates to a compressor pump with multiple blade impeller.

Numerous pumps have been provided in prior art that are adapted to move thick liquids away from center of the pumps by centrifugal force. For example, U.S. Pat. Nos. numbered 4,347,035; 4,427,336 and 4,648,796 all are illustrative of such prior art. While these units may be suitable for the particular purpose to which they address, they would not be as suitable for the purposes of the present invention as heretofore described.

SUMMARY OF THE INVENTION

A primary object of the present invention is to provide a compressor pump with multiple blade impeller that will overcome the shortcomings of the prior art devices.

Another object is to provide a compressor pump with multiple blade impeller that will convey fluids so as to be used for high pressure air blowers, liquid pumps, jet pumps, water jet propulsion, vacuum cleaners, etc.

An additional object is to provide a compressor pump with multiple blade impeller that when rotated will move fluids towards the center of the pump for compressing the fluids.

A further object is to provide a compressor pump with multiple blade impeller that is simple and easy to use.

A still further object is to provide a compressor pump with multiple blade impeller that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
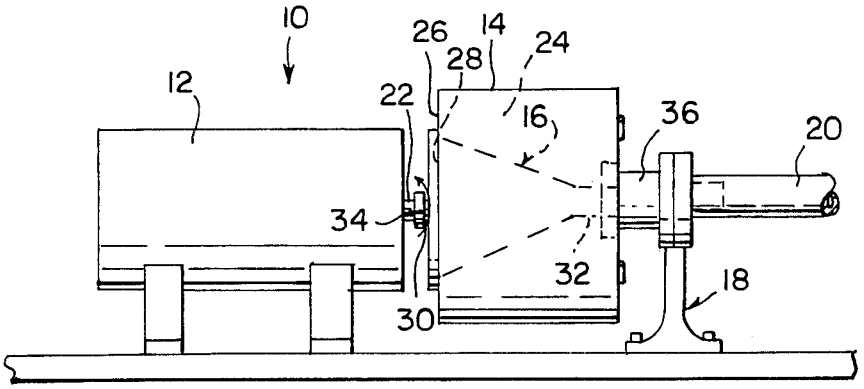
FIG. 1 is a side view of the invention.

Turning now descriptively to the drawings, in which similar reference characters denote similar elements throughout the several views, FIG. 1 illustrates a compressor pump 10 for conveying fluids, such as air or liquids. The pump 10 basically consists of an electric motor 12, a stationary casing 14, a cone-shaped impeller 16, a stationary stand 18 and a hose 20.

The electric motor 12 has a drive shaft 22 while the stationary casing 14 has an operating chamber 24 and an inlet port 26. The cone-shaped impeller 16 has a wide inlet configuration 28 with shaft 30 and a narrow outlet configuration 32. The shaft 30 is coupled at 34 to the drive shaft 22 of the motor 12 so as to be rotatably mounted within the operating chamber 24 of the casing 14 in which fluids entering the casing 14 and through the impeller 16 are compressed to exit therefrom. The stationary stand 18 has a bearing sleeve 36 affixed to the casing 14 and the narrow outlet configuration 32 of the impeller 16 while the hose 20 is affixed to the stand 18 for carrying the compressed fluids from the narrow outlet configuration 32 of the impeller 16.

Figure 2:
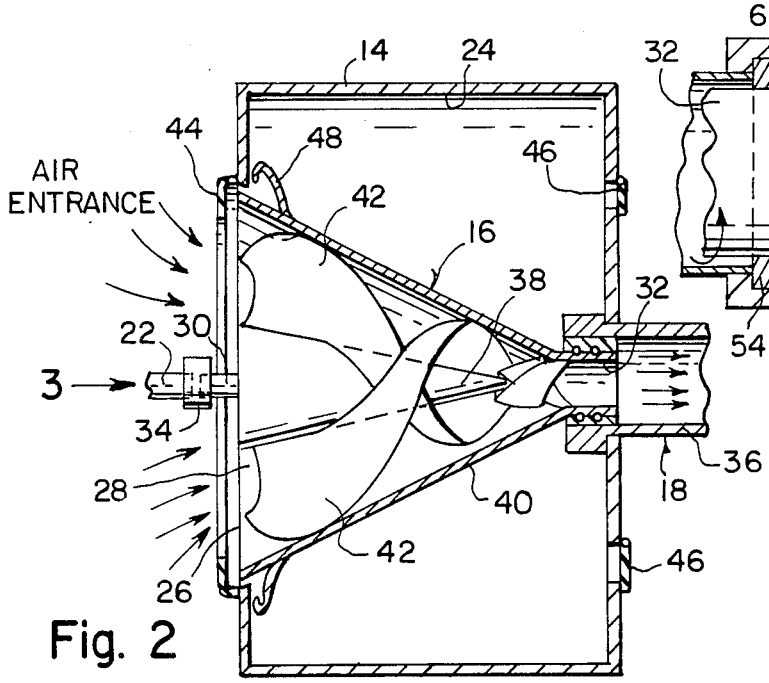
FIG. 2 is a side partial cross sectional view showing the interior impeller blades of the pump in elevation and cone caing in section.
Figure 3:
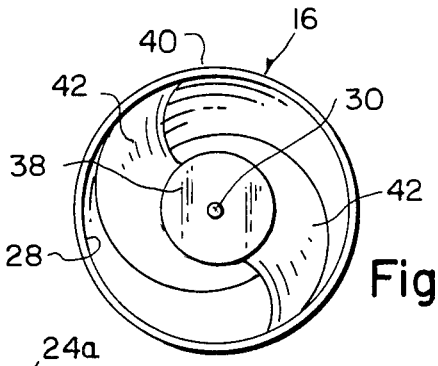
FIG. 3 is an end view taken in direction of arrow 3 in FIG. 2.

As best shown in FIGS. 2 and 3 the impeller 16 contains an inner cone-shaped hub 38, an outer cone-shaped sleeve 40 and a pair of helix-shaped blades 42 encirculing the hub 38 within the sleeve 40. Each of the blades 42 are at an angle which is in the range of 20° to 70° at the wide inlet configuration 28.

An outer fluid deflector 44 is affixed around outside of the inlet port 26 of the casing 14. Flutter valves 46 are mounted to the casing 14 opposite the outer fluid deflector 44. An inner fluid deflector 48 is mounted to the outer cone-shaped sleeve 40 adjacent the outer fluid deflector 44 so as to prevent fluid pressure build up within the operating chamber 24 of the casing 14.

Figure 4:
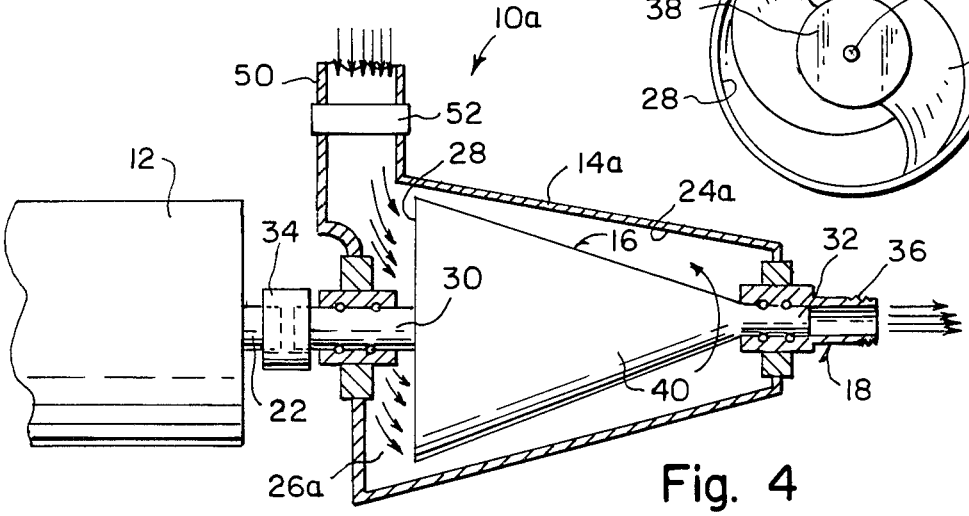
FIG. 4 is a side partial cross sectional view of a modification showing the cone in elevation and the casing in section with a different type of fluid entrance having a check valve.

A modified compressor pump **10*a* is shown in FIG. 4 in which a conduit 50 extends tangently from one side of the inlet port 26*a* of the casing 14*a* for carrying the fluids into the casing. A check valve 52 is mounted within the conduit 50 to prevent fluid back pressure build up within the operating chamber 24*a* of the casing 14*a***.

Figure 5:
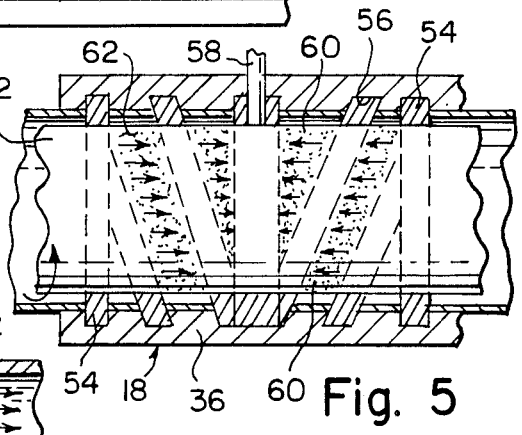
FIG. 5 is a side cross sectional view of a modified stationary sleeve with a lubrication system therein.

FIG. 5 shows a plurality of spiral rings 54 wrapped around the narrow outlet configuration 32 at an angle and fitted in grooves 56 on the sleeve 36 of the stationary stand 18. An oil entrance tube 58 extends through the sleeve 36 and center of the spiral rings 54 so that when the narrow outlet configuration 32 rotates oil 60 will lubricate surface 62 of the narrow outlet configuration 32 betwen the spiral rings 54.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A compressor pump for conveying fluids which comprises:

(a) an electric motor having a drive shaft;

(b) a stationary casing having an operating chamber and an inlet port;

(c) a cone-shaped impeller having a wide inlet configuration with shaft and a narrow outlet configuration, the shaft coupled to the drive shaft of said motor so as to be rotatably mounted within the operating chamber of said casing in which fluids entering said casing and through said impeller are compressed to exit therefrom;

(d) a stationary stand having a bearing sleeve affixed to said casing and the narrow outlet configuration of said impeller;

(e) a hose affixed to said stand for carrying the compressed fluids from the narrow outlet configuration of said impeller, wherein said impeller comprises:

(a) an inner cone-shaped hub;

(b) an outer cone-shaped sleeve;

(c) a pair of helix-shaped blades encircling said hub within said sleeve, each of said blades at an angle which is in the range of 20° to 70° at the wide inlet configuration, further comprising:

(a) an outer fluid deflector affixed around outside of the inlet port of said casing;

(b) at least one flutter valve mounted to said casing opposite said outer fluid deflector; and (c) An inner fluid deflector mounted to said outer cone-shaped sleeve adjacent said outer fluid deflector so as to prevent fluid pressure buildup within the operating chamber of said casing.

2. A compressor pump for conveying fluids which comprises:

(a) an electric motor having a drive shaft;

(b) a stationary casing having an operating chamber and an inlet port;

(c) a cone-shaped impeller having a wide inlet configuration with shaft and a narrow outlet configuration, the shaft coupled to the drive shaft of said motor so as to be rotatably mounted within the operating chamber of said casing in which fluids entering said casing and through said impeller are compressed to exit therefrom;

(d) a stationary stand having a bearing sleeve affixed to said casing and the nawrow outlet configuration of said impeller;

(e) a hose affixed to said stand for carrying the compressed fluids from the narrow outlet configuration of said impeller, wherein said impeller comprises:

(a) an inner cone-shaped hub;

(b) an outer cone-shaped sleeve; and (c) a pair of helix-shaped blades encircling said hub within said sleeve, each of said blades at an angle which is in the range of 20° to 70° at the wide inlet configuration, further comprising:

(a) a conduit extending tangently from one side of the inlet port of said casing for carrying the fluids into said casing; and (b) a check valve mounted within said conduit to prevent fluid back pressure build up within the operating chamber of said casing.

3. A compressor pump as recited in claim 2, further comprising:

(a) a plurality of spiral rings wrapped around the narrow outlet configuration at an angle and fitted in grooves on the sleeve of said stationary stand; and (b) an oil entrance tube extending through the sleeve and center of said spiral rings so that when thenarrow outlet configuration rotates oil will lubricate surface of the narrow outlet configuration between said spiral rings.

* * * * *